United States Patent [19]

Hiromori

[11] Patent Number: 4,738,558

[45] Date of Patent: Apr. 19, 1988

[54] WRITTING TOOL

[75] Inventor: Junji Hiromori, Tokyo, Japan

[73] Assignee: Hiromori Industrial Company, Tokyo, Japan

[21] Appl. No.: 872,708

[22] Filed: Jun. 10, 1986

[30] Foreign Application Priority Data

Jun. 17, 1985 [JP] Japan ..... 60-90156[U]

[51] Int. Cl.[4] ..... B43K 24/00

[52] U.S. Cl. ..... 401/35; 401/34; 401/6; 401/102; 401/209; 401/213; 273/155; 446/487

[58] Field of Search ..... 401/35, 34, 6, 195, 401/29, 30, 99, 209, 102, 213; 273/155; 446/487

[56] References Cited

U.S. PATENT DOCUMENTS

| | | | |
|---|---|---|---|
| 1,783,436 | 12/1930 | Kratochvil | 401/34 |
| 4,149,812 | 4/1979 | Hoffman, Jr. | 401/6 |
| 4,653,949 | 3/1987 | Larizza | 401/99 |

FOREIGN PATENT DOCUMENTS

| | | | |
|---|---|---|---|
| 2553716 | 4/1985 | France | 401/6 |
| 250922 | 7/1948 | Italy | 401/34 |
| 6802 | of 1899 | United Kingdom | 401/34 |

*Primary Examiner*—Richard J. Apley
*Assistant Examiner*—Franklin L. Gubernick
*Attorney, Agent, or Firm*—Hoffmann & Baron

[57] ABSTRACT

A ballpoint pen which does not require use of a separate cap member is constituted in the form of a linkage of four levers which form a holder. At least one of the four levers is formed to be hollow so as to receive a writing element therein; and the front portion of said writing element projects out of the end of one part of a given connected piece of one of four connecting bodies firmly fitted into an opening portion of each end of the four levers. A concave portion is provided in a second part of the given connected piece for receiving the front portion of said writing element when the ballpoint pen is in closed pen condition. The tip of each lever is joined to the tip of an adjacent lever by a hinge element.

10 Claims, 8 Drawing Sheets

WRITTING TOOL

FIELD OF THE INVENTION AND RELATED ART STATEMENT

The present invention relates to an improved writing tool; and more particularly relates to an improved writing tool such as a ballpoint pen, which does not require a closure. A writing tool such as a ballpoint pen, etc. generally is constituted by a main body or holder for the ball point and which is held by the user in his hand when writing. A removable cap is also provided and can be fitted onto the holder for protection of the ball point when the pen is not used. The filler of a conventional ballpoint pen will generally correspond in length to the length of said holder; and accordingly there can be instances where the ink contained in the filler is not used to the last. While this is uneconomical, it has been accepted as being an unavoidable incident of many ballpoint pen constructions. Although the cap when taken off the holder at the time of pen use is usually fitted onto the non-writing end of the holder for the prevention of loss, this is not always done so frequently the cap becomes lost. When the cap is lost or not returned in covering position over the ball point, the ballpoint pen thereafter becomes unusable due to drying of the ink contained in the filler.

Another consideration relating to ballpoint pens is that since they are seldom used to the end, little attention has been given to providing them with an unusual and attractive appearance.

OBJECT AND SUMMARY OF THE INVENTION

With the above background in mind, it is an objective of the present invention, to provide an improved writing tool such as a ball point pen to overcome the drawbacks associated with premature ink drying caused by loss of the cap member. Another object of the present invention is to provide a ballpoint pen which does not require use of a cap.

Still another object of the present invention is to provide a ballpoint pen which has a pleasant and attractive appearance.

The above-mentioned objects of the present invention can be attained by providing a ballpoint pen which comprises four levers linked together and hinged for movement one relative to another so that the four levers can be folded into two positions where they present two opposed pairs of such levers wherein one pair confronts in face-to-face contact with the other pair, one such position representing a pen writing disposition and the other position, a closed pen condition. Connecting bodies comprising hinge means are carried in adjacently disposed ends of the four levers, i.e., part of each hinge means body is carried at one end of a lever and the other part of that body in the adjacent end of a precedingly or suceedingly adjacently situated lever in the linkage. At least one of the four levers is formed hollow so as to dispose a writing element such as a ballpoint pen filler therein, a front or writing tip portion of said element projecting through the hinge means part at one end of the said one lever. The other part of the hinge means body which is carried in the adjacent end of an adjacent lever has a concave portion which can receive nested therein, the front or writing tip portion of the filler when the writing tool is folded to the closed pen condition. This arrangement dispenses with the need for use of a conventional cap inasmuch as the ballpoint writing tip is thus housed in a cap-equivalent enclosure, i.e., the concave portion. When the writing tool is folded to its other or writing disposition, the filler writing tip end projects outwardly unimpededly from the said one end of said one lever for writing purposes. At the other end of said one lever, the part of a hinge means body which is carried at said other end has a recessed portion or bore. This recessed portion or bore is provided so that a projecting button formed on the other part of that hinge means body (carried in another adjacent lever) can locate within the said bore when the writing tool is folded to writing position or if the writing tool is folded to closed pen condition, project exposed from the adjacent end of said other adjacent lever.

As described hereinabove, according to the present invention, since the four levers are connected in the form of a linkage by bendable and deformable connecting bodies, it is possible to orient said four levers into a certain one rectilinear configuration (pen writing position) or another rectilinear configuration (closed pen condition) orthogonal to the first and on account of the linkage constituting a parallelogram mechanism. The levers in the linkage are alternately provided on the contacting faces thereof with a projection or a slotted opening. These projections and slotted openings are used to cooperate by the projections entering engageably in the slots so as to maintain the levers in a given position, i.e., to maintain them folded in writing disposition or to maintain them in closed pen condition.

Figure 1:
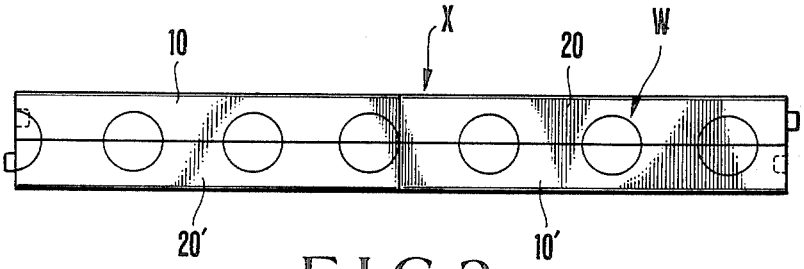
FIG. 1 to FIG. 10 show one embodiment according to the present invention, wherein the present invention is applied to a ballpoint pen.
Figure 2:
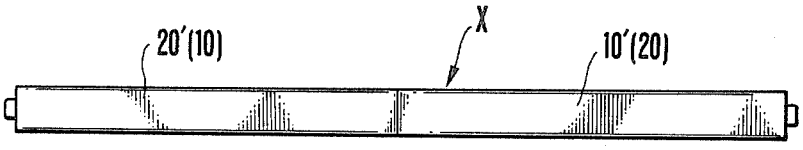
Figure 3:
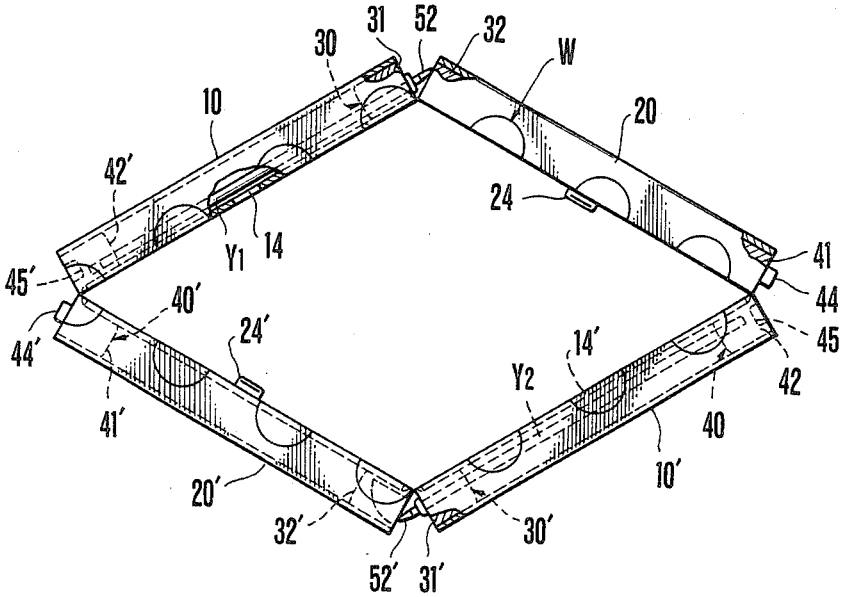
Figure 4:
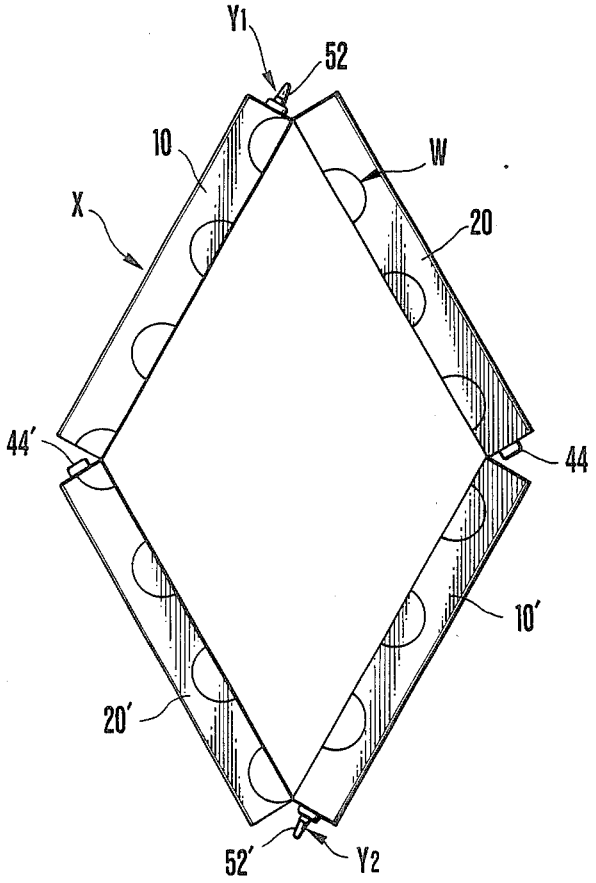
Figure 5:
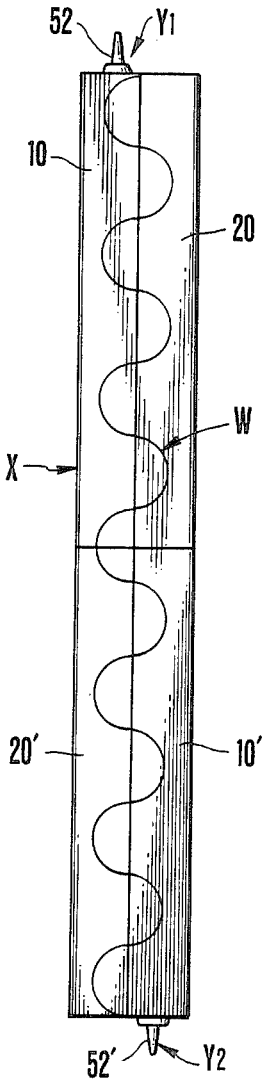
Figure 10:
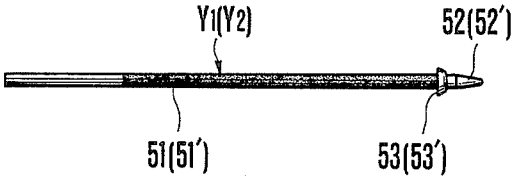
Figure 11:
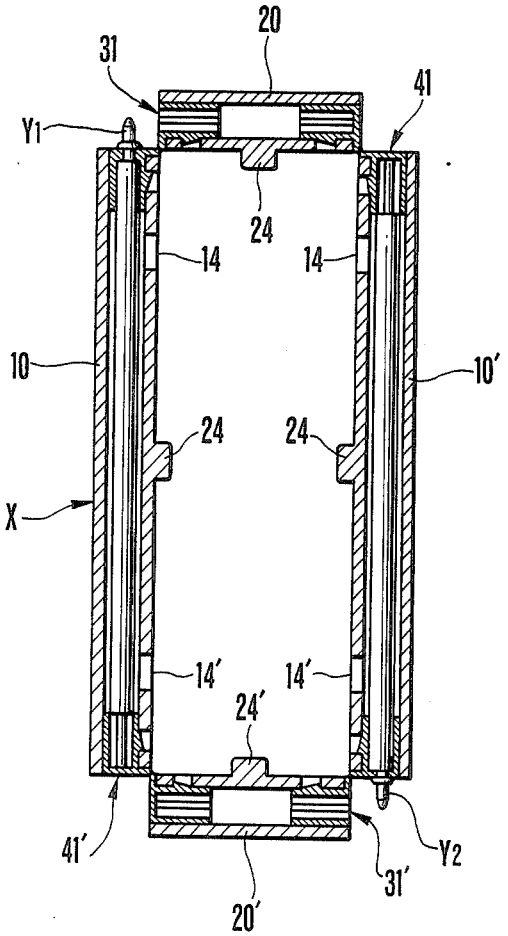
Figure 12:
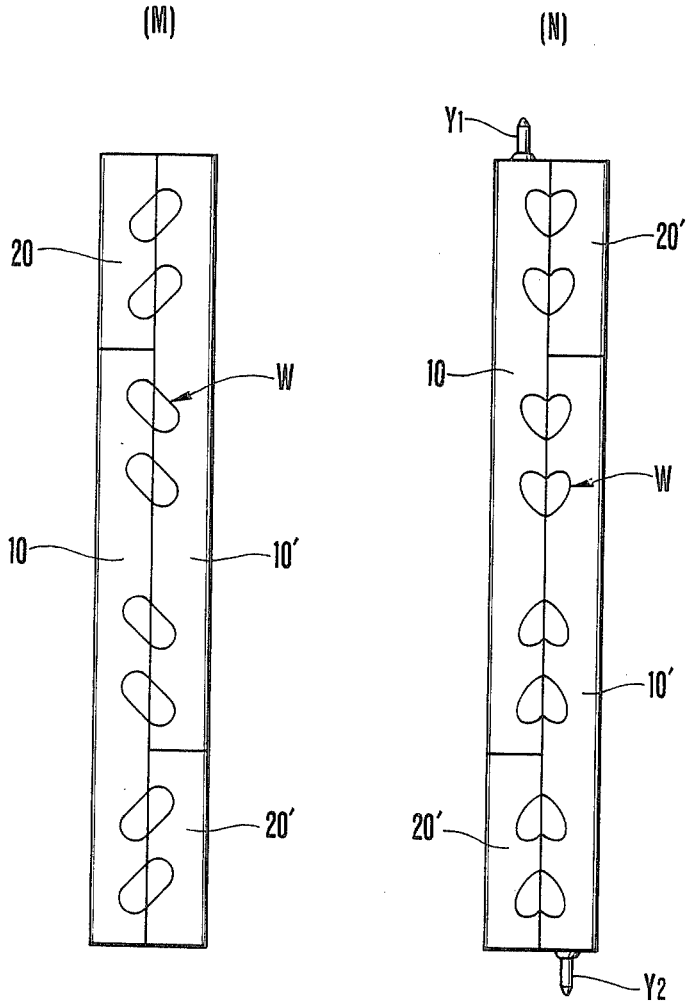
Figure 13:
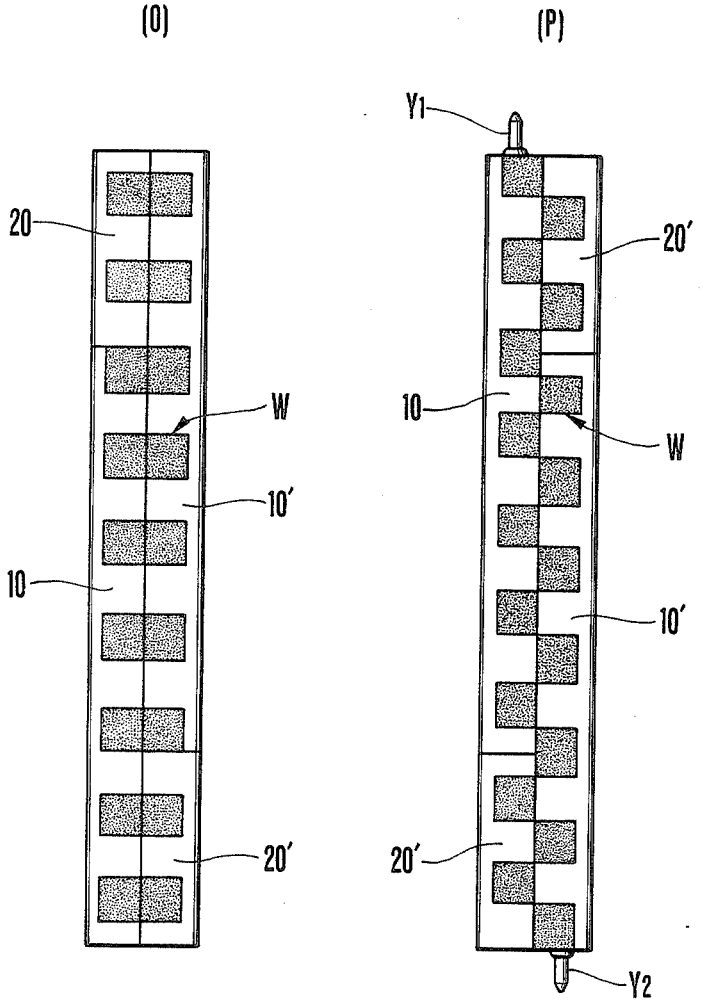
Figure 14:
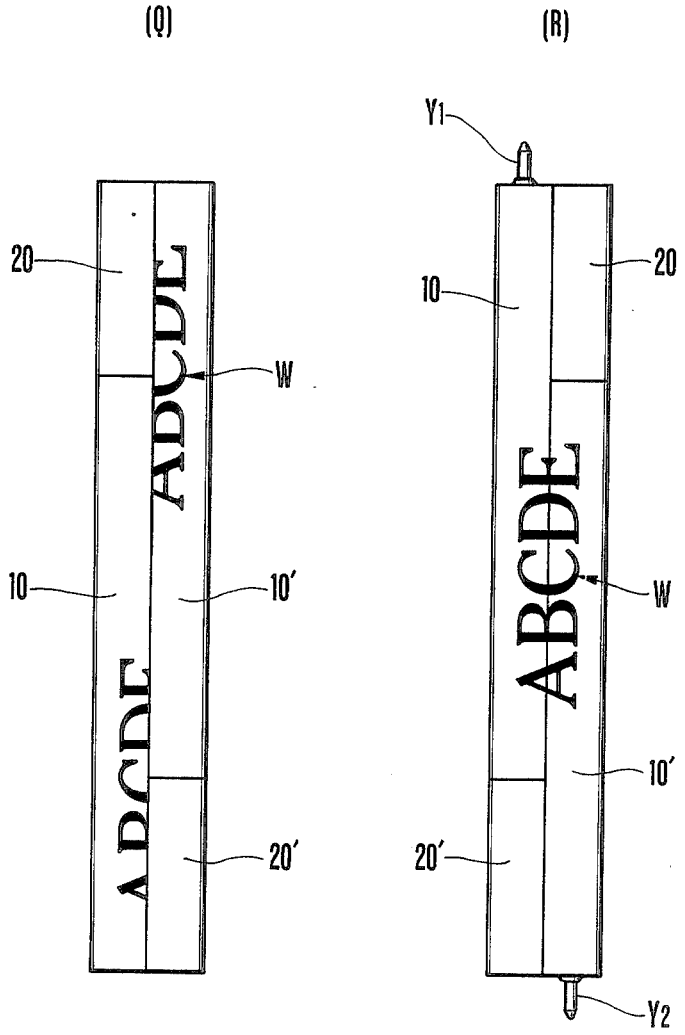

Among said Figures,

FIG. 1 is a top view of said ballpoint pen in its non-use or closed pen condition;

FIG. 2 is a side view of the ballpoint pen shown in FIG. 1;

FIG. 3 and FIG. 4 are views, respectively, for explaining change of a configuration of said ball(point) pen from its non-use to the use thereof;

FIG. 5 is a top view of said ball pen in its use or writing position;

FIG. 6(A) is a front view of one of the two forms of levers which are used for forming a holder;

FIG. 6(B) is a top view of said lever shown in FIG. 6(A);

FIG. 6(C) is a sectional view taken along line 1—1 in FIG. 6(A);

FIG. 7(D) is a front view of the second form of lever used in cooperation with the first for forming a holder;

FIG. 7(E) is a top view of said lever;

FIG. 7(F) is a sectional view taken along line 11—11 in FIG. 6(A);

FIG. 8(G) is a front view of one of the two types of connecting bodies used with the levers;

FIG. 8(H) is a top view of said connecting body;

FIG. 8(I) is a side view seen from an arrow line in FIG. 8(G);

FIG. 9(K) is a front view of the second type of connecting body;

FIG. 9(L) is a top view thereof;

FIG. 10 is a top view of a filler for use with the aforementioned ballpoint pen;

FIG. 11 is a top view of a ballpoint pen in its cross section for explaining another embodiment provided by the present invention;

FIG. 12 to FIG. 14 are views respectively explaining each example of a pattern which can be applied to the holder and denotive of writing and closed pen positionings.

DETAILED DESCRIPTION OF THE PREFERRED EMBODIMENTS

Hereinafter, embodiments according to the present invention will be described in detail with reference to the drawings. FIG. 1 to FIG. 10 are one embodiment according to the present invention in which the present invention is applied to a ballpoint pen provided with fillers containing black and red ink therein. A main body of said ballpoint pen is composed of a holder X and a filler containing black ink $Y_1$ and a filler containing red ink $Y_2$ as writing element (Refer to FIG. 10.)

W is a pattern designed to provide an attractive appearance for the surface of holder X and the pattern may also be used for the quick and easy determination of positioning of the writing tool, i.e., if it be in pen writing or pen closed condition.

Four levers 10,10',20,20' comprise a holder of the ballpoint pen and four connecting bodies 30,30',40,40' connect the four levers to each other in the form of a closed linkage.

Figure 6:
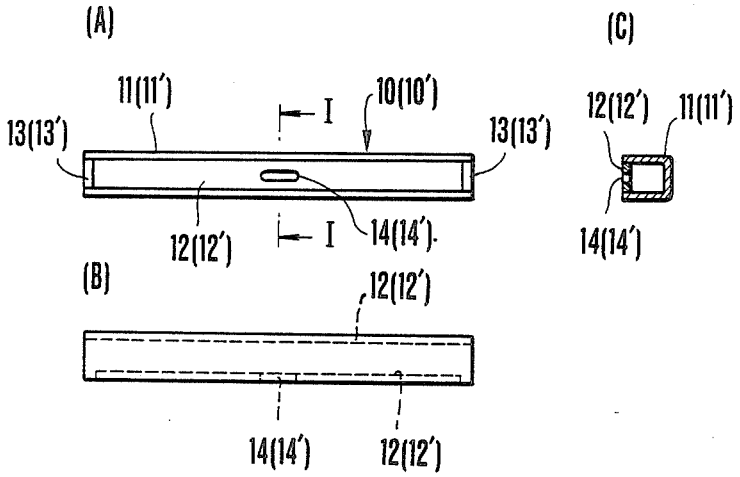
Figure 7:
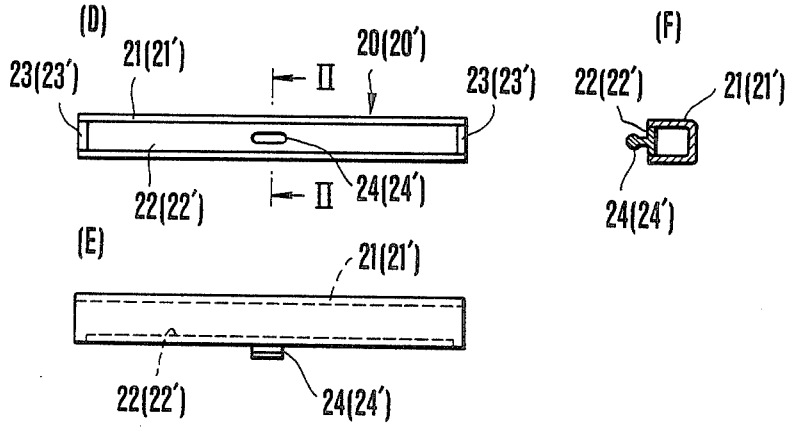

The levers 10,10',20,20' are made of a hard material and the main bodies of said levers 11,11',21,21' have the isostructural and isometric concave channeled shape as shown in FIG. 6 and FIG. 7.

Within opening portions present in a longitudinal direction of said main bodies 11,11',21,21', side plates 12,12',22,22' are provided, which side plates are shorter than the main bodies, and are made of isostructural and isometric hard material and provide isostructural concave portions 13,13,13',13',23,23,23',23' at both ends of said plates.

When the length of the side plates 12,12',22,22' is arranged to be equal to that of the main bodies 11,11',21,21', the concave portions 13,13,13',13',23,23,23',23' are formed by notching one portion of both edges of the side plates 12,12',22,22'. At a middle portion of the side plates 22',22', engaging projections 24,24' are provided, the outer end of which is somewhat enlarged. The middle part of said side plates 12,12' is provided with slots 14,14' for engaging and disengaging with the engaging projections 24,24' to hold the ballpoint pen in one or the other of its two folded positions, i.e., in writing position or closed pen condition. The levers 10,10', 20,20' forming the holder X are formed to be hollow and also to be substantially isostructural and isometric.

Figure 8:
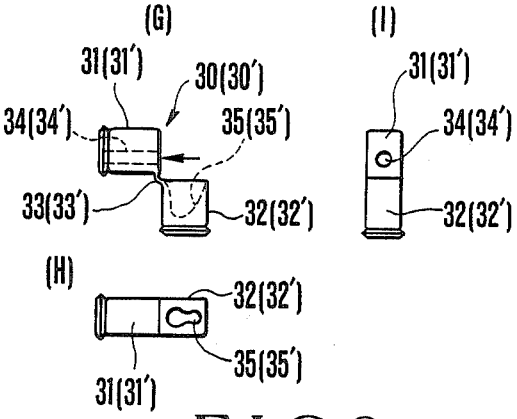

The connecting bodies 30,30' are made of a flexible material to be substantially isostructural and isometric as shown in FIG. 3 and FIG. 8. That is to say, the connecting bodies 30,30' are provided with connected pieces 31,32,31',32' which firmly fit into the opening portions of each end of the levers 10,20,10',20' these pieces further being provided with short bendable and deformable coupling bands 33,33'. Those skilled in the art will readily perceive that the coupling bands being of flexible material and bendable and deformable, provide for hinging action between the two connoted pieces. Bores 34,34' in pieces 31,31' firmly receive in pass through, a main portion or front tip end part of the fillers $Y_1$,$Y_2$. At the other sides of the connected pieces 32,32', concave portions 35,35' are provided and these accommodate ball points 52,52' of the fillers $Y_1$,$Y_2$ when the ballpoint pen is in closed pen condition.

Figure 9:
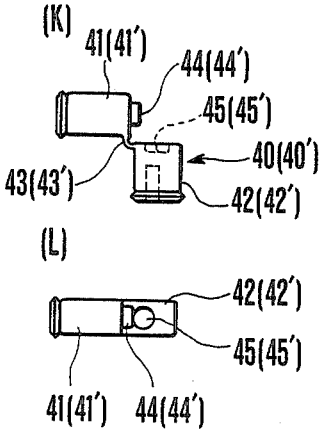

The connecting bodies 40,40' are made of a soft flexible material which is substantially isostructural and isometric and are formed as shown in FIG. 3 and FIG. 9. That is to say, the connecting bodies 40,40' are provided with connected pieces 41,42,41',42' which firmly fit into the opening portions of each adjacent end of the levers 20,10',20',10, these pieces further being provided with short bendable and deformable coupling bands 43,43' for coupling bodies 41 and 42 and 41' and 42', respectively. Small projections 44,44' for maintaining a writing position configuration of the holder are respectively formed on the connected pieces 41,41' at one side of the connecting bodies 40,40'. On the other side of the connected pieces 42,42', bores 45,45' for receiving said small projections 44,44' are provided.

As clear from FIG. 3 and FIG. 4, the holder is constituted in a manner that a pair of levers 10,10' and the other pair of the levers 20,20' are arranged to be a link by disposing said each pair of the levers alternatively. The connected pieces 31,32 of the connecting body 30 are respectively fitted firmly into the opening portions of each adjacent end of said levers 10,20 disposed alternatively as aforementioned. The connected pieces 41,42 of the connecting body 40 are also fitted firmly into the opening portions of each adjacent end of the levers 20,10'.

The connected pieces 31',32' of the connecting body 30' are respectively fitted firmly into the opening portions of each adjacent end of the levers 10',20'. The connected pieces 41',42' of the connecting body 40' are respectively fitted firmly into the opening portions of each adjacent end of the levers 20',10'.

As shown in FIG. 10, the filler containing black ink $Y_1$ consists of a main body 51, a ball point 52 and a small flanged portion 53 formed in the vicinity of said point 52. The front portion of said filler 51 is fitted firmly into the bores 34 for fitting firmly said filler 51 in an associated lever 10. The filler 51' containing red ink $Y_2$ is fitted firmly into the bore 34 perforated at the end of the connected piece 31 of the connecting body 30', the filler 51' being associated with and fitting firmly into lever 10'.

When the ballpoint pen according to the present embodiment is in or has been folded to closed pen condition, the four levers 10,10',20,20' connected in linkage form are arranged so that the inner surfaces of said levers 10,20' confront each other face-to-face and the inner surfaces of levers 20,10' are confronting and contacting with each other. An intermediate position of the writing tool between closed pen condition and writing position is shown in FIG. 3. The closed pen condition rectilinear configuration is shown in FIG. 1 or FIG. 2. In such closed pen condition, the ball points 52,52' of the fillers $Y_1$,$Y_2$ are easily and smoothly forced into the concave portions 35,35' of the connecting bodies 32,32' for the protection thereof and furthermore the engaging projections 24,24' formed at the inner surfaces of said levers 20,20' are respectively fitted into the engaging bores 14,14' provided at the inner surfaces of the lever 10,10, thereby maintaining the aforementioned configuration so that said ball points 52,52' may sufficiently be protected without use of a conventional pen cap.

On the other hand, when the ballpoint pen according to the present embodiment is to be used in writing position, the holder X is folded to a rectilinear configuration orthogonal to the rectilinear configuration as shown in FIG. 1, being moved through the intermediate folding configurations as shown in FIGS. 3 and 4. By pushing the portions in the vicinities of the connecting portions of the levers 10,20 and the lever 10',20' it will move into the pen writing position shown in FIG. 5. In such state, the ball points 52,52' of the fillers $Y_1,Y_2$ are exposed. Furthermore, the small projections 44,44' for maintaining a holder configuration of the connected pieces 41,41' of the connecting bodies 40,40' are respectively fitted into the bores 45,45' provided at the other connected pieces 42,42'. Still furthermore, the engaging projections 24,24' of the levers 20,20' are fitted into the bores 14,14' provided at the levers 10,10', maintaining the writing configuration.

As will be understood from the above description, it is possible that the length of the fillers $Y_1,Y_2$ may be arranged to be less than half of that of conventional one so as to lessen the quantity of ink contained in the fillers. This can prevent inconvenience due to a quantity of ink remaining in the pen that is inaccessible at the writing tip which is often observed in a conventional ballpoint pen even if the length of the holder X is arranged to be equal to that of a conventional ballpoint pen.

The marking W shown in FIG. 1 to FIG. 5 is an example of a pattern designed on the filler X for enhancing pen appearance and also can be used for easily and quickly detecting a pen writing or non-writing condition. The pattern shown in FIG. 1 denotive of closed pen condition, is designed in a manner such that circles with the same radius and having centers on the contacting line of the inner surfaces of the levers 10,20' and the levers 20,10' are provided. The distance between each circle is arranged to be double the radius thereof. Said pattern changes to a sine curve as shown in FIG. 5 when the ballpoint pen is folded into a writing position. This arrangement and the varieties in depiction effected with the circles enhances the appearance of the pen and aids in detecting easily and quickly the condition as to the use or non-use thereof. The aforementioned pattern may be varied as described hereinafter. FIG. 11 is another embodiment according to the present invention. According to this form, a pair of the levers 10,10' respectively provided with the fillers $Y_1,Y_2$ are longer than the other pair of the levers 20,20' in order to reinforce the strength of the holder X when the ball pen is used. Because of this arrangement of the four levers, the holder X is strengthened when it is used. In this embodiment, the holder X may alternatively be deformed to one rectilinear configuration and the other rectilinear configuration orthogonal thereto due to its being a link mechanism of a parallelogram.

According to said embodiment, the engaging projections 24,24',24,24' are formed at substantially the middle of the inner surfaces of the levers 10,10',20,20' and further the engaging bores 14,14',14,14' are formed at each prescribed position of both ends of the inner surfaces of the levers 10,10'.

When the holder X of the FIG. 11 embodiment is arranged in one rectilinear configuration, the engaging projection 24 of the lever 20 engages with the engaging bore 14 of the lever 10; the engaging projection 24 of the lever 10 engages with the engaging bore 14 of the lever 10'; the engaging projection 24' of the lever 10' engages with the engaging bore 14' of the lever 10 and the engaging projection 24' of the lever 20' engages with the engaging bore 14' of the lever 10'.

When said holder X of the FIG. 11 embodiment is arranged to the other rectilinear configuration, the engaging projection 24 of the lever 20 engages with the engaging bore 14 of the lever 10'; the engaging projection 24' of the lever 10' engages with the engaging bore 14 of the lever 10; the engaging projection 24 of the lever 10 engages with the engaging bore 14' of the lever 10' and the engaging projection 24' of the lever 20' engages with the bore 14' of the lever 10.

Accordingly, when the ball pen is folded to a writing position, the ball points of the fillers $Y_1,Y_2$ are exposed, and when said ballpoint pen is arranged to a closed pen condition, the ball points of the fillers $Y_1,Y_2$ are exposed, and when said ballpoint pen is arranged to a closed pen condition, the ball points of the fillers $Y_1,Y_2$ enter into the concave portions of the connected pieces of the connecting bodies as in the case of the first-mentioned embodiment. In this embodiment, said ballpoint pen is not provided with small projections 44,44' and concave portions 45,45' as used with the first embodiment.

FIG. 12 to FIG. 14 are other embodiments according to the present invention, wherein examples of the decorative pattern W are shown. In a closed pen condition, the ballpoint pen as shown in FIG. 12(M), has a plurality of ellipses designed with an inclination of 45 degree covering both sides of the holder X. When the ballpoint pen is folded to a writing position, a plurality of heart patterns are formed from the changed ellipse positionings and as shown in said FIG. 12(N). At a closed pen condition of the ballpoint pen shown in FIG. 13(O), a plurality of rectangles cover both sides of the holder X. When the ballpoint pen is arranged to a writing position, these rectangles form a plurality of squares in zigzag in a longitudinal direction thereof as shown in FIG. 13(P). At a closed pen condition as shown in FIG. 14(Q), certain prescribed characters in proportion without any definite meaning in themselves are designed at each one side of the half portions of said holder X. When the pen is folded to a writing position, characters such as A,B,C and D are formed with the design as shown in FIG. 14(R).

Either one of said fillers $Y_1,Y_2$ according to the aforementioned embodiments may be arranged instead of two of them. Said fillers $Y_1,Y_2$ may also be provided as colored pencils, or common pencils. Furthermore, instead of the small projections 44,44' for maintaining a holder configuration, those may be substituted by an eraser so as to be buried into the connected pieces 41,41', or one of them may be arranged to an eraser and the other may be arranged to be a knife, paper knife or small brush, etc.

As is clear from the above description, according to the present invention, it is possible to lessen to a degree the length of a conventional ballpoint pen, etc. as a writing tool and furthermore a cap is not required. Thus, according to the present invention, an economical and improved form of pen with an enhanced appearance is possible.

What is claimed is:

1. A writing tool such as a ball point pen or the like comprising four levers, four connecting bodies each of two pieces joined by a middle portion, each connecting body comprising a hinge means for joining adjacent ends of the levers so as to link said levers together as a foldable parallelogram, one piece of each connecting body fitting in an end of one lever and the other piece thereof fitting in an adjacent end of a lever next to said one lever, each connecting body being bendable and deformable at its middle portion whereby the parallelogram can be folded between two orthogonally disposed positions thereof constituting respectively, a pen writing position and a closed pen condition, the levers in each of said two parallelogram positions presenting opposed pairs of levers in confronting side face-to-side face contact, at least a first of said levers carrying a writing element including a pen tip end therein, said pen tip end extending through the connecting body piece at an end of said first lever and beyond said end of said first lever, said tip end being exposed for writing use when the parallelogram is in pen writing position, the connecting body pieces in the lever end adjacent said end of said first lever having a concave portion wherein the said pen tip end is received and protected when the parallelogram is in closed pen condition, and cooperating engaging projection and slot means carried on said levers operable in each of said two parallelogram folded positions by removably retained reception of a projection in a slot for maintaining said levers in said position.

2. The writing tool according to claim 1, wherein two alternate ones of the levers in the parallelogram are longer than the levers intervened by said two alternate ones, there being an engaging projection carried substantially at mid-length of the side faces of each of said four levers and slots corresponding to each said engaging projection being provided adjacent each end of the side faces of said two alternate levers.

3. The writing tool according to claim 2, wherein the levers intervened by the two alternate levers are shorter than the alternate levers to strengthen the parallelogram when it is in pen writing position.

4. The writing tool of claim 1 or 2 wherein the levers each are provided with a pattern of denotive markings, the markings on each lever cooperating with those on the others in such way that when the parallelogram is in the respective pen writing and closed pen positions, the pattern effect produced by the cooperating lever markings is different in one of said parallelogram positionings from that produced by such markings in the other parallelogram position.

5. The writing tool according to claim 4, wherein the markings on said levers are such that they cooperate to form a pattern of a plurality of ellipses when the parallelogram is in closed pen position and cooperate to form a plurality of hearts when the parallelogram is in pen writing position.

6. The writing tool according to claim 4, wherein the markings on said levers are such that they cooperate to form a pattern of a plurality of rectangles when the parallelogram is in closed pen position and cooperate to form a plurality of zig-zag arranged squares when the parallelogram is in pen writing position.

7. The writing tool according to claim 4, wherein the markings on said levers are such that they represent characters having no definite meaning when the parallelogram is in closed pen position but which cooperate to form meaningful characters when the parallelogram is in pen writing position.

8. The writing tool of claim 1 wherein at least the connecting body joining the other end of said first lever with a lever adjacent thereto includes a button projection on one of its two pieces and a recessed portion in the other of said two pieces, such recessed portion receptively enclosing said button projection when the parallelogram is in pen writing position, the button projection being exposed when the parallelogram is in closed pen position.

9. The writing tool of claim 1, wherein a second of said levers carries a writing element including a pen tip end thereon, the pen tip of such second lever writing element extending through the connecting body piece at an end of said second lever and beyond said end and being exposed for writing when said parallelogram is in pen writing position.

10. The writing tool of claim 9 wherein the writing element carrying first and second levers are alternate ones in the parllelogram.

* * * * *